US005810298A

United States Patent [19]

Young et al.

[11] Patent Number: 5,810,298

[45] Date of Patent: Sep. 22, 1998

[54] RAILROAD SPRING FROG ASSEMBLY

[75] Inventors: Keith Young, Naperville; Stephen R. Kuhn, Richton Park, both of Ill.

[73] Assignee: ABC Rail Products Corporation, Chicago, Ill.

[21] Appl. No.: 848,803

[22] Filed: May 1, 1997

[51] Int. Cl.[6] ..... E01B 7/14

[52] U.S. Cl. ..... 246/276; 246/468

[58] Field of Search ..... 246/275, 276, 246/382, 305, 386, 389, 391, 454, 472, 468

[56] References Cited

U.S. PATENT DOCUMENTS

| | | | |
|---|---|---|---|
| 501,070 | 7/1893 | Higgins | 246/276 |
| 505,022 | 9/1893 | Boyd | 246/276 |
| 627,438 | 6/1899 | Partington | 246/276 |
| 877,562 | 1/1908 | Graham | 246/276 |
| 930,709 | 8/1909 | Whiteman | 246/276 |
| 4,624,428 | 11/1986 | Frank | 246/276 |
| 5,544,848 | 8/1996 | Kuhn et al. | 246/276 |

*Primary Examiner*—S. Joseph Morano
*Attorney, Agent, or Firm*—Thomas S. Baker, Jr.

[57] ABSTRACT

An improved railroad trackwork spring wing frog assembly is provided with multiple rail-closer subassemblies, preferably of the nested and counter-wound compression spring-type, that co-operate with the assembly spring wing rail, and that are laterally spaced-apart with respect to each other along the angled rail portion of the frog assembly spring wing rail.

3 Claims, 2 Drawing Sheets

RAILROAD SPRING FROG ASSEMBLY

CROSS-REFERENCES

None.

FIELD OF THE INVENTION

This invention relates generally to railroad trackworks, and particularly concerns an improved trackwork frog assembly of the spring-rail type which is principally used at railroad trackwork turn-outs from main line track.

BACKGROUND OF THE INVENTION

A railroad frog is a device which is installed at the intersection of two running rails to permit the flanges of railroad car wheels moving along one of the rails to pass across the other rail. The frog supports the car wheels as they pass over the missing rail tread surface between the throat and the point of the frog, and also provides flangeways for the flanges of those car wheels which pass through the frog.

As described in the specification of U.S. Pat. No. 4,624,428, issued in the name of Frank and assigned to the assignee of this application, a standard railroad spring frog includes a rigid wing rail, which is substantially aligned with a long point or heel rail connected to a turnout traffic rail, and a relatively movable wing rail which is substantially aligned with a short point or heel rail that is connected to a main line traffic rail. The movable wing rail is mounted with a yieldable free end, provides a substantially continuous support for the wheels of a rail car passing along the main line track, and may be additionally spring-biased against the frog long point rail by a compression spring type wing rail-closer included in the frog assembly. The movable wing rail, sometimes called a spring wing rail, is moved laterally away from the long point rail to provide a wheel flangeway between the long point rail and the spring wing rail when a car wheel flange traversing the long point or rigid wing rail engages the spring wing rail free end and forces or causes it to move laterally to a full open position. After the last co-operating rail car wheel has passed through the assembly the compression forces induced in the wing rail by bending and by the added rail-closer element cause the movable wing rail to be forcefully moved into its normal abutting relationship with the frog assembly long point rail.

Also, such standard railroad trackwork frogs have utilized conventional horn/horn-holddown assemblies to limit spring wing rail vertical movement when the rail is moved sideways by action of passing car wheel flanges. Such conventional assemblies are often comprised of: (1) sliding-type horn elements that are connected to and project laterally from the spring wing rail, and (2) horn holddown elements that are fastened to a frog base plate, that house riser block elements, and that slidably co-operate with and vertically restrain the sliding-type horn elements.

As described in U.S. Pat. No. 5,544,848 issued in the name of Kuhn et al. and also assigned to the assignee of this application, further improvements have been made to the earlier trackwork spring rail-type frog assemblies, particularly with respect to the construction and operation of the included wing rail holddown. The further improvement included a roller outrigger and co-operating inclined ramp holddown construction in lieu of the conventional sliding-horn/horn-holddown assembly that was susceptible to excessive base plate abrasive wear and excessive riser block abrasive wear.

It has now been additionally noted in connection with the performance of known trackwork spring rail-type frog assemblies that the typically-included A.R.E.A single point compression closure spring sub-assembly can function as an undesirable pivot point for the assembly spring wing rail. The flangeway-opening forces transmitted into the spring wing rail from the flange of a railcar wheel passing through the frog assembly can impose loads upon the spring wing rail that through repeated action change the configuration and dimensional features of wing rail bends included in the assembly thereby affecting the both the accuracy of the fit between the assembly wing rail and included V-shaped frog point and the wheel path through the frog.

We have discovered a new and useful railroad trackwork frog assembly construction, including a new and useful compression spring-type rail-closer subassembly arrangement for the trackwork frog, which greatly minimizes the unwanted spring wing rail distortion resulting from repeated bending of the wing rail relative to the single rail-closer pivot point.

Other objects and advantages of the present discovery will become apparent during a careful consideration of the invention summary, description of the drawings, and detailed description which follow.

SUMMARY OF THE INVENTION

The novel railroad trackwork frog assembly of this invention is essentially comprised of a base plate element, a fixed wing rail element secured to the base plate element, a movable spring wing rail element mounted on the base plate element and having a free end portion, and a pair of laterally spaced-apart rail-closer elements which typically take the form of nested compression springs and which are each rigidly connected at one extreme to the base plate element and at the other extreme may be either yieldably connected to or rigidly connected to the movable wing rail element. In addition, the frog assembly typically advantageously includes one or more slide-horn and holddown subassemblies that function to control or maintain proper spring wing rail cross-section vertical orientation at all times during spring wing rail lateral movement, and may optionally include a outrigger roller and inclined ramp subassembly of the type disclosed in U.S. Pat. No. 5,544,848.

DETAILED DESCRIPTION

Figure 1:
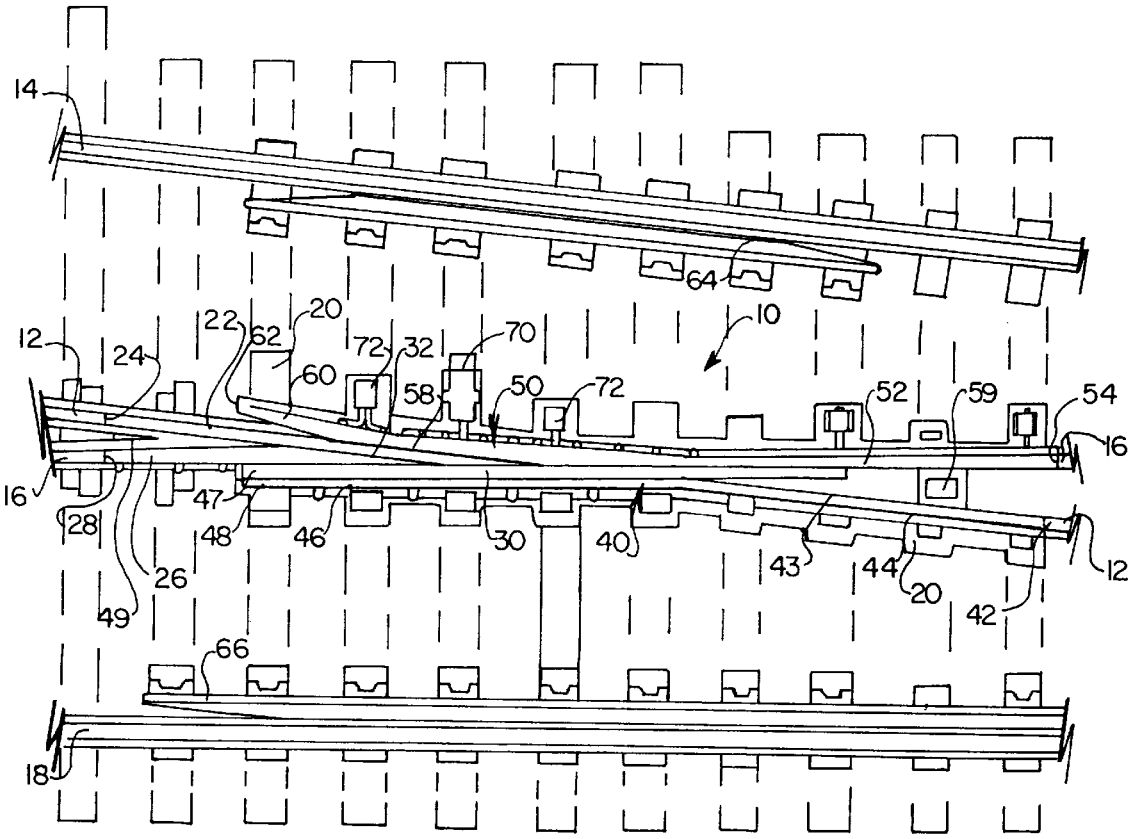
FIG. 1 PRIOR ART
FIG. 1 is a plan view of a prior art and conventional A.R.E.A. railroad trackwork spring frog assembly having a single closure spring configuration.

Referring to FIG. 1, a conventional or prior art right-hand spring frog assembly 10 is shown inserted in one rail 12 of a pair of turnout rails 12, 14 and one rail 16 of a pair of mainline rails 16, 18. Spring frog 10 is assembled and mounted on a base plate element 20 which provides a level foundation for the frog and which maintains the elements which comprise the frog in their proper relationship during assembly, shipping, and subsequent installation in a railroad trackwork. Frog assembly 10 is functionally positioned to permit flanged rail car wheels riding along rail 12 to cross rail 16 and flanged rail car wheels riding along rail 16 to cross rail 12. A conventional switch stand for directing rail cars from rail pair 12, 14 to rail pair 16, 18 and vice versa is necessary for the trackwork but does not comprise a portion of frog assembly 10.

A long point rail element 22 is mounted on base plate 20 at the heel end of frog assembly 10 and has a rail end 24 which upon frog installation is joined, as by welding, to turnout line rail 12 to provide a connection for that rail to frog assembly 10. A short point rail 26 is also mounted on base plate 20 and has a rail end 28 which upon frog installation is joined, as by welding, to mainline rail 16 to connect that rail to frog assembly 10. Long point rail element 22 and short point rail element 26 are mounted on base plate element 20 at an included angle relative to each other which is known as the angle of frog. A heel block element 49 may be bolted into position with and between long and short point rail elements 22 and 26 to maintain the desired angle and spacing between such point rail elements, and also a heel riser element (not illustrated) may be provided to protect the point rails from damage due to car wheels having false flanges. See U.S. Pat. No. 4,362,282 for a description of the false flange protection problem. Long point rail element 22 terminates with a tapered vertical surface 30 on one side which is substantially parallel with mainline rail 16, and short point rail element 26 terminates with a tapered vertical surface 32 on one side which is substantially parallel with turnout rail 12. Surface 32 is complementary to and engages one side of long point rail 22. The pointed end of long rail element 22 terminates with a width of approximately one-half inch and is known as the half inch point of the frog assembly.

The generally-curved, fixed wing rail element 40 of frog assembly 10 is connected to a turnout closure rail section 43, having a long body section 44, and has a joined, angled body section 46 that is oriented generally parallel to short point rail element 26. Upon installation, closure rail section 43 is joined at its end 42 to a section of turnout rail 12. The end 48 of wing rail element 40 is preferably flared so that the flange of a car wheel moving along short point rail element 26 toward element 40 will not strike the wing rail free end. An elongated inter-rail spacer or filler 47 is positioned intermediate and joined to the web portions of short-point rail 26 and fixed wing rail end portion 46 and also intermediate and joined to the web portions of long-point rail 24 and rail end portion 46 and functions to establish a continuously open flangeway between those rails principally to accommodate the car wheel flanges of rail cars passing through frog assembly 10 on mainline tracks 16 and 18. A spacer block element 59 may be advantageously positioned at the toe end of frog assembly 10 and bolted to and between long body section 44 and the adjacent spring-rail body section to maintain proper spacing and included angle of intersection between those elements. Also, rigid wing rail element 40 is rigidly secured to base plate element 20 by conventional means such as plate clips. Thus, rigid wing rail element is a relatively immovable member of frog assembly 10.

The yieldably-mounted spring wing rail element 50, which is the primary movable member of frog assembly 10, has a straight, long body section 52 which terminates at an end 54 that upon installation is joined to a section of mainline rail 16. Element 50 also has an angled body section 58 which is at the opposite end of long body section 52. Angled body section 58 is parallel to and engages (abuts) the side of long point rail 22 opposite that engaged by short point rail 26. The free end 60 of angled body section 58 is flared so that no portion of its very end 62 can be accidentally struck by the flange of a car wheel moving from the long point rail element 22 toward spring wing rail element 50. It should be noted that spring wing rail 50 at its angled body section 58 and at its free end 60 is not secured to base plate element 20 either by conventional plate clips or the like.

Thus, when the flange of a car wheel engages spring wing rail 50 at its free end 60 and causes it to move laterally so that a flangeway is provided between long point rail 22 and spring wing rail 50, rail 50 is stressed and flexed from the point of wheel engagement to where it is attached to spacer block 59. Spring wing rail element 50 is acting essentially as a cantilevered beam with a force applied at or close to its free end 60.

The railroad trackwork installation shown in FIG. 1 also typically includes a pair of conventional guard rail elements 64, 66 having flared ends which are positioned at turnout rail 14 and at mainline rail 18, each in spaced-apart relation to the adjacent rail by a distance that is slightly greater than the standard car wheel flange thickness, respectively. Such function to "protect" rail 50 from lateral forces caused by possibly skewed car wheels.

In addition, and as shown in FIG. 1, the known railroad spring frog assembly 10 typically includes one or more holddown subassemblies 72, each such subassembly 72 being rigidly connected in-part to spring wing rail 50 and in-part to base plate element 20. Subassemblies 72 function, during periods when a rail car wheel flange engages the free end 65 of spring wing rail 50 to cause lateral displacement of rail 50 thereby limiting upwards vertical movement of the rail while permitting rail lateral movement.

Also, the known A.R.E.A. railroad trackwork spring wing frog assembly includes a single conventional rail-closer subassembly 70 which develops a substantial initial compression force that maintains spring wing rail 50 in its abutting engagement with long point rail element 22 in the absence of rail car traffic passing through assembly 10, that develops an increased compression force resisting opening movement of spring wing rail element 50 as that rail is moved laterally by a rail car wheel flanges passing through the frog assembly, and that utilizes such increased compression force to forcefully close spring wing rail element 50 and move it into its initial position of forceful contact with long point rail element 22 after a co-operating rail car wheel flange has passed through the frog assembly.

As previously suggested, we have noted with respect to the prior art frog assembly construction that the rail bends provided in spring wing rail element 50 can become distorted during the course of prolonged and repeated use thereby resulting in inaccuracy in the fit of spring wing rail 50 to point rail 22 and subsequent adverse effect on the rail car wheel flange path through the frog. We believe that such results from the single closure spring subassembly 70 acting as a pivot about which spring wing rail element 50 may bend, such pivot point being in addition to the basic spring wing rail pivot point provided at the juncture of that rail element with spacer block 59.

Figure 2:
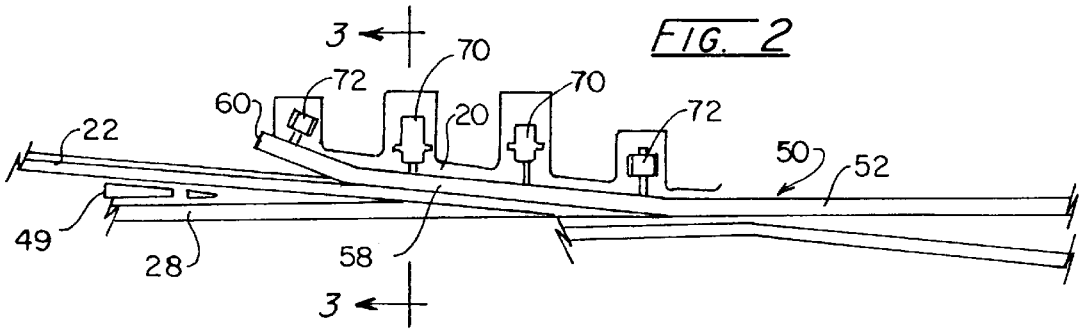
FIG. 2 is an enlarged plan view of a portion of a spring frog assembly similar to that of FIG. 1 but incorporating a preferred embodiment of the present invention.
Figure 3:
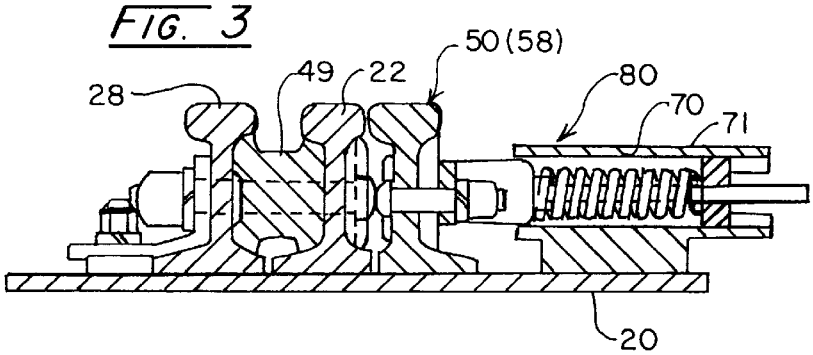
FIG. 3 is a section view taken at line 3—3 of FIG. 2 and provides details regarding the included conventional rail-closer subassemblies.

In FIG. 2 we provide details of a preferred embodiment of a railroad trackwork spring wing frog assembly 80 which is constructed in accordance with the present invention and which avoids the above-discussed operating disadvantage associated with those conventional spring wing frog assemblies that utilize the single rail-closer element or subassembly 70 arrangement schematically depicted in FIG. 1 and shown in more detail in FIG. 3. Basically, our preferred spring wing frog assembly 80 utilizes multiple (generally two), laterally spaced-apart rail-closer elements 70 or subassemblies installed in co-operating relation with the frog assembly spring wing rail instead of the conventional single rail-closer element. As detailed in FIG. 3, the conventional rail-closer subassemblies 70 of frog assembly 80 each include the known nested and counter-wound compression spring construction 71 that: (1) may be adjusted to create an initial or residual compression force that forcefully maintains wing rail 50 in its closed condition, and (2) is further compressed during wing rail opening movement by car wheel flange action to cause additional rail-closer spring compression and thereby increase the force available to cause wing rail 50 at its angled body section 58 to be returned to its closed condition after the last rail car wheel flange has passed through frog assembly 80. Each rail-closer subassembly 70 functions to establish, in a separate zone of its attachment to angled body section 58 of spring wing rail element 50, added resistance to rail deflection otherwise caused by flangeway-opening forces of railcar wheel flanges passing through frog assembly 80. As shown in FIG. 2, one such subassembly 70 is appreciably spaced-apart from, and is substantially closer to the free end 60 of spring wing rail 50 than, the other such subassembly. Of course a single coiled compression spring may be utilized in place of the aforesaid double nested and counter wound coiled compression spring 71.

Figure 4:
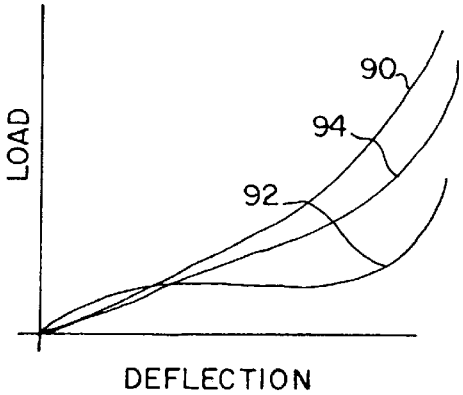
FIG. 4 is a schematic plot of load/deflection curves pertaining to trackwork frog assembly spring wing rails in different rail-closer element placement configurations.

The plotted curves of FIG. 4 in-part illustrate advantages associated with the present invention. Curve 90 illustrates wing rail deflection as a function of the opening load imposed by the passing rail car wheel flange in instances when the conventional frog assembly does not include a rail-closer subassembly. Curve 92 illustrates the degree of induced wing rail deflection that results from the flange-induced rail load when the frog assembly includes but a single rail-closer subassembly as illustrated in FIG. 1. Curve 94 illustrates the degree of induced wing rail deflection which is obtained through practice of the present invention. It should be noted that the curvature of curve 94 significantly corresponds more closely to the curvature of curve 90 than does curve 92 and thus indicates a substantially more uniform distribution of bending stresses throughout the moved length of the frog assembly movable wing rail. The advantage becomes even more significant when applied to frog assemblies having longer wing rails.

Figure 5:
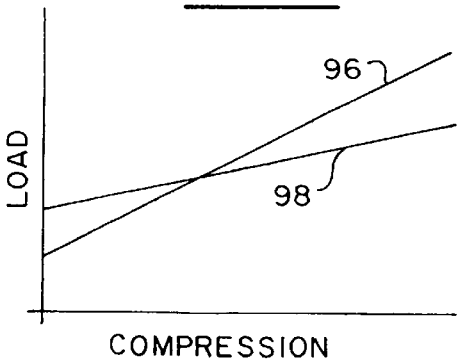
FIG. 5 is a load/compression curve pertaining to trackwork frog assembly spring wing rails having two different rail-closer element placement configurations.

FIG. 5 illustrates curves 96 and 98 that relate to the degree of spring compression that is obtained as a function of different applied loads for both the FIG. 1 and FIG. 2 rail-closer subassembly configurations. Curve 96 pertains to the A.R.E.A. standard single rail-closer frog assembly configuration, and curve 98 relates to the dual rail-closer subassembly configuration for a railroad trackwork frog assembly in accordance with our invention. It should be noted that the curve 98 spring rate (slope) is significantly reduced in comparison to the spring rate of the curve 96 arrangement. The advantage is that the wing rail can now be held closed by a larger total force and can be opened at a rate of increasing force that is lower than the corresponding force rate of the trackwork spring wing rail frog assembly with a single rail-closer configuration. This also reduces the effect of the rail-closer subassembly acting as a fulcrum around which the wing rail can be bent.

Other component shapes, sizes, and materials may be substituted for the component shapes, sizes, and materials described above to obtain the advantages of this invention and without departing from the claimed scope of the invention.

We claim as our invention the apparatus defined by the following claims.

We claim:

1. In a railroad trackwork frog assembly having a relatively rigid wing rail and a partially movable spring wing rail, and also having at least two spring type rail-closer subassemblies for yieldably holding the partially movable spring wing rail against a railroad trackwork traffic rail, in combination:

a base plate element;

a spring wing rail element having a long rail section which is fixedly secured to said base plate element, an angled body section which is joined to said long rail section and is supported by said base plate element but not in a fixed manner, and a free end section which is joined to said angled body section distant from said long rail section;

a first rail-closer subassembly attached to said spring wing rail element angled body section at a first zone of added resistance to deflection, fixedly secured to said base plate element, and yieldable in response to deflections of said spring wing rail element by forces of railcar wheel flanges traversing the trackwork frog assembly; and a second rail-closer subassembly attached to said spring wing rail element angled body section at a second zone of added resistance to deflection that is substantially closer to said spring wing rail element free end section than is said angled body section first zone of added resistance to deflection, fixedly secured to said base plate element, and also yieldable in response to deflections of said spring wing rail element by forces of a railcar wheel traversing the trackwork frog assembly, said rail-closer subassemblies each being principally and functionally comprised of compression spring elements.

2. The invention defined by claim 1 wherein said first and second rail-closer subassemblies are each principally and functionally comprised of coiled and nested compression springs.

3. The invention defined by claim 1 wherein said first and second rail-closer subassemblies are each principally and functionally comprised of a single coiled spring.

* * * * *